US005898642A

United States Patent [19]

Wagner

[11] Patent Number: 5,898,642

[45] Date of Patent: Apr. 27, 1999

[54] SONAR ANTENNA

[75] Inventor: Jean-Marie Wagner, Cavalaire, France

[73] Assignee: Etat Francais represente par le Delegue General pour l'Armement, Paris, France

[21] Appl. No.: 08/836,613

[22] PCT Filed: Sep. 26, 1996

[86] PCT No.: PCT/FR96/01504

§ 371 Date: Jun. 12, 1997

§ 102(e) Date: Jun. 12, 1997

[87] PCT Pub. No.: WO97/11789

PCT Pub. Date: Apr. 3, 1997

[30] Foreign Application Priority Data

Sep. 28, 1995 [FR] France ..... 95/11371

[51] Int. Cl.[6] ..... B06B 1/06

[52] U.S. Cl. ..... 367/158

[58] Field of Search ..... 367/153, 157, 367/158

[56] References Cited

U.S. PATENT DOCUMENTS 3,593,257 7/1971 Massa, Jr. ..... 367/158
5,515,342 5/1996 Stearns et al. ..... 367/158

FOREIGN PATENT DOCUMENTS 2 603 761 3/1988 France .
2 077 552 12/1981 United Kingdom .

*Primary Examiner*—Daniel T. Pihulic
*Attorney, Agent, or Firm*—Oliff & Berridge PLC

[57] ABSTRACT

The invention relates to the field of sonar antennas, in particular those intended to be installed on an underwater vehicle in order to constitute a mounted head of the vehicle. Specifically, the invention relates to a sonar antenna having at least two identical transducers that exhibit sensitivity peaks at at least two frequencies $\nu$, and $\nu_2$, wherein the head mass dimension of the transducers is between 0.35 and 0.65 times the wavelength $\lambda_2$ corresponding to the higher of the frequencies $\nu_1$ and $\nu_2$.

4 Claims, 5 Drawing Sheets

SONAR ANTENNA

BACKGROUND OF THE INVENTION

The present invention relates to the field of sonar antennas, in particular those intended to be installed on an underwater vehicle in order to constitute a mounted head of said vehicle. It relates in particular to a sonar antenna capable of operating in different frequency bands.

A sonar antenna generally consists of a large number of transducers Each transducer, for example a receiving transducer, consists of an element for converting the pressure energy that propagates in the liquid medium into electrical energy that can be processed by electronic means. In an underwater antenna such as that used in sonars for torpedoes, the transducers are arranged alongside one another on an acoustically transparent material which ensures energy transfer; they are moreover fastened mechanically, in a more or less complex manner, onto a support capable of withstanding compression forces.

One example that may be cited is French Patent No. 2603761, which describes a sonar antenna constituting the mounted head of an underwater vehicle, said antenna having a core which is a block of rigid syntactic foam that is resistant to immersion-related hydrostatic pressure, said block having receptacles in each of which is placed an electro-acoustic transducer, the outer surface of which is flush with the outer surface of said block. This antenna has a sealed casing made of an acoustically transparent material, which is overmolded around the block and the transducers and which has a hydrodynamic tapered profile which extends that of the vehicle hull, and means for fastening onto the outer surface of the front end of the vehicle hull. Underwater antennas can operate exclusively passively or actively, or can have the capability for simultaneous active and passive operation.

In all cases, the antenna possesses an optimum operating frequency which is characterized by the fact that sampling of the sensitive area, in other words the number of transducers per unit area, is suitable; and, for active antennas, that each transducer can convert electrical energy into mechanical energy with the best possible efficiency. In an effort to meet the needs of designers of torpedo seeker heads, who are demanding more and more frequency agility for the sonar, experiments with "wide-band" active antennas have led to the design, by more or less complex means, of transducers whose efficiency remains at a level sufficient for a frequency excursion on the order of 30% of the optimum frequency. Factors which, however, still cannot be varied as a function of frequency are on the one hand the dimension of the transducer head mass which constitutes the coupling element between the medium and the energy conversion material, said dimension establishing the area sampling; and on the other hand the dimensions of the constituent parts of the transducers, which establish the optimum operating frequency.

The "dimension" of a transducer head mass is understood to mean the diameter of the head mass if it is in the shape of a flattened cylinder, or the length of one side if it is in the shape of a rectangular parallelepiped with a square base.

For physical reasons relating to energy transmission and reduced interaction among the transducers, the designer arranges the elements at distances that remain close to half the wavelength that is propagating in the medium.

British Patent No. 2,077,552 describes a sonar antenna which can be used to search for shoals of fish or sandbanks, and which has transducers that emit at two frequencies $\nu_1$, and $\nu_2$, respectively 55 kHz and 130 kHz, the dimension of the head mass of each transducer being substantially equal to half the wavelength $\lambda_1$ corresponding to frequency $\nu_1$. With an antenna of this kind, however, efficiency drops considerably when the transducers are operating at frequency $\nu_2$. Moreover an antenna of this kind cannot be used in a torpedo seeker head because of its very low directivity.

SUMMARY OF THE INVENTION

A particular object of the present invention is to eliminate these drawbacks by proposing a sonar antenna which has high efficiency in multiple frequency bands $\nu_1$, $\nu_2$, etc., and reconciles optimum spatial sampling for said multiple frequency bands while retaining the ability to transmit on several frequency bands.

A sonar antenna according to the invention has identical transducers that exhibit sensitivity peaks at at least two frequencies $\nu_1$ and $\nu_2$, and is characterized in that the head mass dimension of said transducers is between 0.35 and 0.65 times the wavelength $\lambda_2$ corresponding to the higher of the frequencies $\nu_1$ and $\nu_2$.

This dividing up of the sensitive area of the antenna leads to the production of a large number of elements, which would result in a fairly high cost for a conventional industrial-scale implementation based on bonding the elements side by side onto a surface. Another characteristic of the invention consists in using the following steps during manufacture of the transducers:

In a first step, coating a plate of material intended to constitute the head masses with a coating of an acoustically transparent material;

In a further step, cutting up the plate, but not the coating, so as to form an array of juxtaposed head masses separated by said cuts.

A method according to the invention for manufacturing the array of transducers according to the invention can thus be as follows:

In a first step, threaded holes are made, in a square array, in a plate of material suitable for constituting the head masses, for example aluminum, the distance separating two successive holes being substantially equal to half the wavelength $\lambda_2$;

In a second step, said plate is covered with a layer of acoustically transparent material. For example, said material can be rubber deposited by vulcanization to ensure complete adhesion. Said coating is intended to constitute the sealed casing of the antenna at the torpedo head;

In a third step, grooves are made in the longitudinal direction and the transverse direction of the plate, to constitute a mosaic of head masses of square or rectangular shape, the axes of which correspond to those of the threaded holes and the length of whose sides is substantially equal to half the wavelength $\lambda_2$;

In a fourth step, a prestressing rod, at least one of whose ends is threaded, is screwed into each of the threaded holes of the plate;

In a fifth step, a piezoelectric motor and then a tail mass, which have an axial hole and are dimensioned so as to operate at the two frequencies $\nu_1$ and $\nu_2$, are fastened to each of the prestressing rods, each transducer then being constituted.

It is thus possible to produce a sonar antenna having at least two transducers of the type having a prestressing rod, a piezoelectric motor, a head mass, and a tail mass, wherein the head mass consist of a plate having grooves so as to delimit them, said plate being covered with an acoustically transparent material.

With the aim of obtaining optimum operation of the antenna according to the invention at all frequencies, a method for implementing it consists, when the transducers are operating at a frequency less than the highest frequency based on which the head masses of the transducers were dimensioned, in electrically grouping multiple transducers so that, for that frequency, the equivalent characteristic dimension of the head masses of that group of transducers is between 0.35 and 0.65 times the corresponding wavelength.

BRIEF DESCRIPTION OF THE DRAWINGS

Other advantages and characteristics of the present invention will be evident from a description of an embodiment applied to underwater torpedoes, with reference to the appended figures among which.

DESCRIPTION OF THE PREFERRED EMBODIMENTS

Figure 1A:
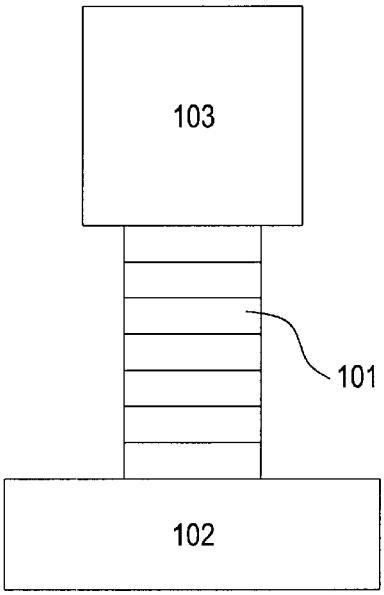
Fig. 1a PRIOR ART
FIG. 1*a* shows a conventional transducer.

FIG. 1*a* shows a transducer according to the prior art. It is dimensioned so as to be able to operate at one or more frequencies, and has an energy conversion element 101, a head mass 102, and a tail mass 103, the assembly being joined by means of a prestressing rod (not shown).

Figure 1B:
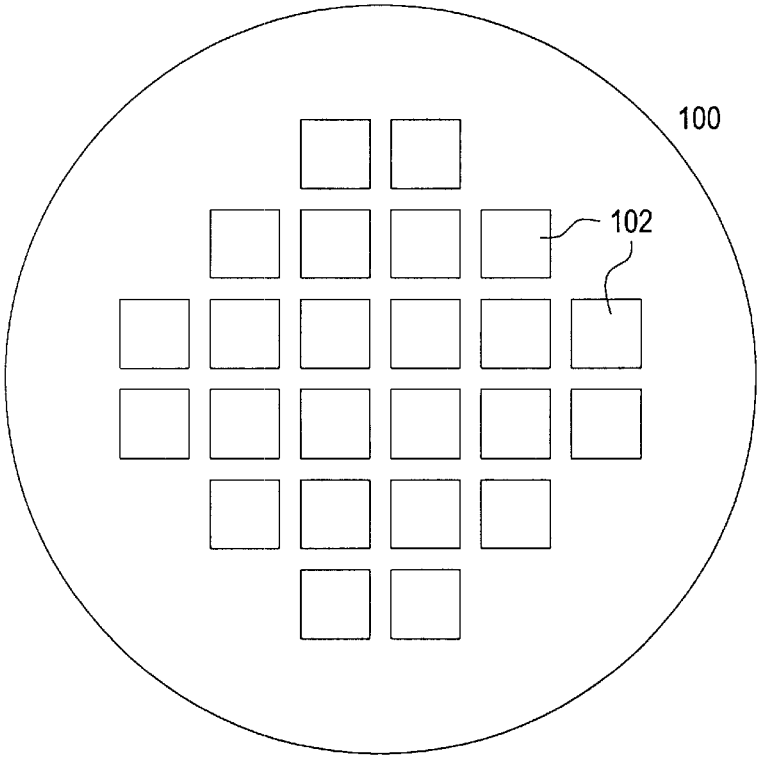
Fig. 1b PRIOR ART
FIG. 1*b* shows a conventional layout of the transducers in an antenna.

FIG. 1*b* shows a conventional layout of the transducers in an antenna 100.

They are identical and are dimensioned so as to transmit at a specific frequency $\nu_1$, the dimension of the transducer head masses being substantially equal to the value of half a wavelength $\lambda_1$, and the distance separating two adjacent transducers also being on the order of half a wavelength. Note that the frequency and the wavelength are linked by the equation $\nu_1=C/\lambda_1$, where in this instance C is the speed of sound in the medium.

Figure 2A:
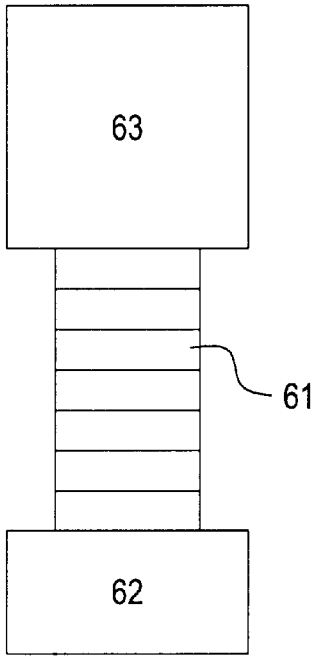
FIG. 2*a* shows a transducer according to the invention.
Figure 2B:
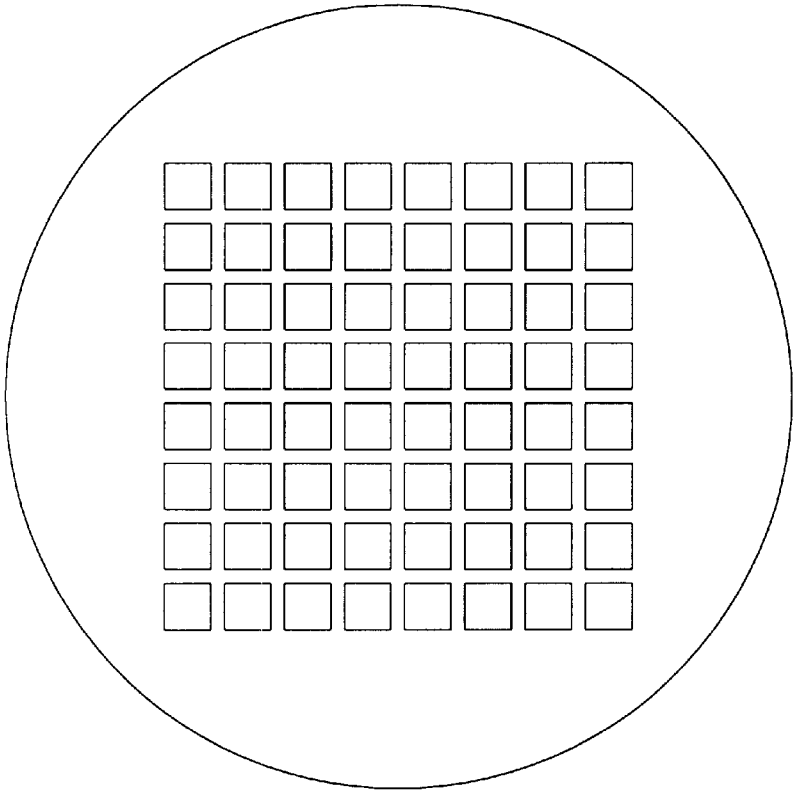
FIG. 2*b* shows an antenna using the transducers.
Figure 3A:
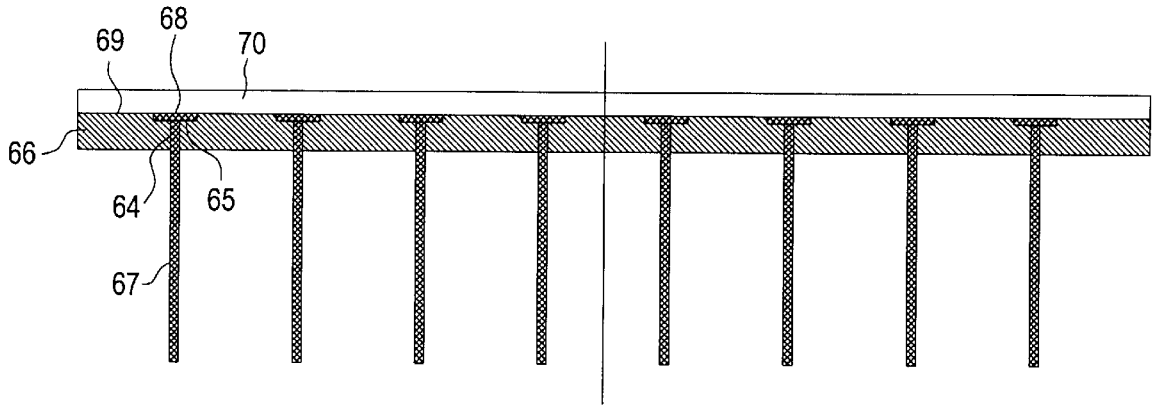
FIG. 3*a* shows holes having a countersinking in a square array.
Figure 3B:
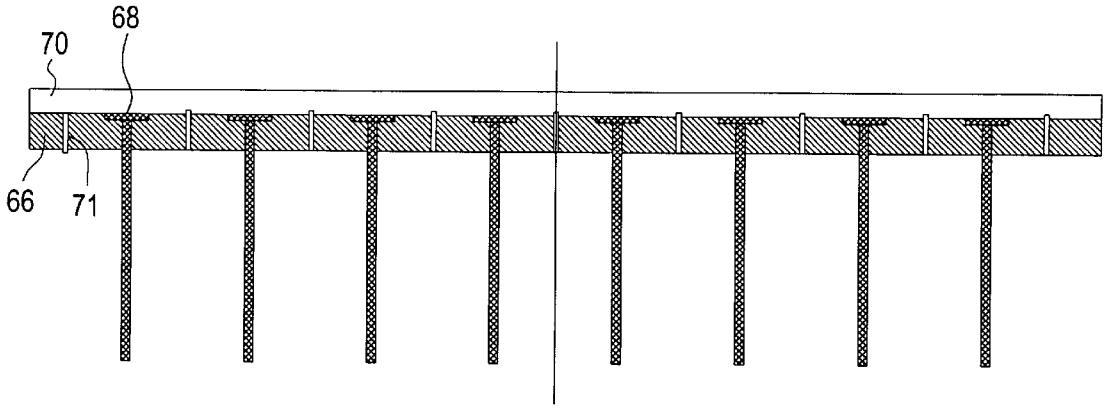
FIG. 3*b* shows grooves in a longitudinal and transverse direction of the plate.
Figure 3C:
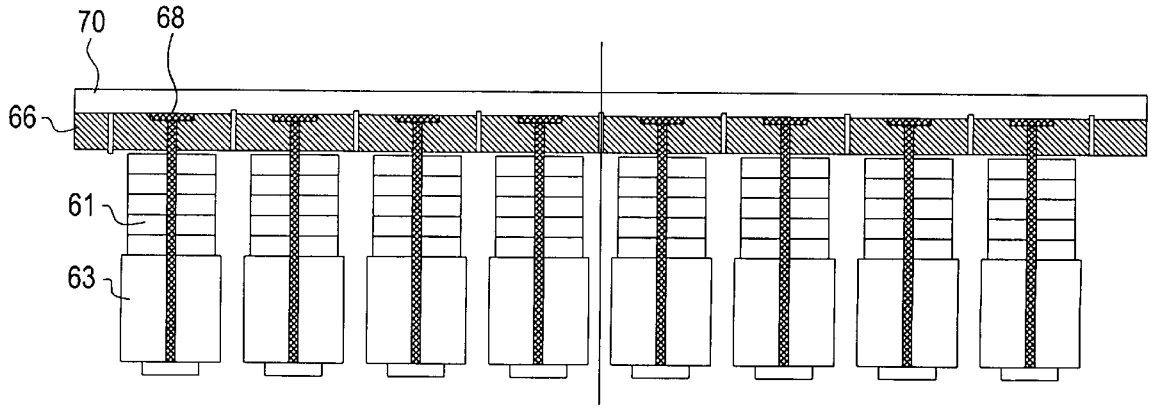
FIG. 3*c* shows transducers mounted on the plate using prestressing rods.

FIG. 2 shows an antenna 50 according to one embodiment of the invention. Transducers 60 are identical and are dimensioned, in known fashion, for example by means of simulation software, to transmit at a first frequency $\nu_1$ as well as a second frequency $\nu_2$ corresponding to a harmonic frequency of $\nu_1$. For example, $\nu_1$ can be made equal to 15 kHz, and $\nu_2$ can correspond to a frequency on the order of 45 kHz. They have an energy conversion element 61, a head mass 62, and a tail mass 63, the assembly being joined by means of a prestressing rod (not shown).

As far as area sampling is concerned, the characteristic dimension of the head mass, i.e. the diameter if it is in the shape of a flattened cylinder or the length of one side if it is in the shape of a rectangular parallelepiped with a square base, is selected as a function of the wavelength $\lambda_2$ corresponding to frequency $\nu_2$. In this embodiment, said dimension is selected to be equal to half said wavelength $\lambda_2$.

It is evident that such dimensioning increases the number of transducers, as compared to the prior art, by a factor equal to $(\lambda_1/\lambda_2)^2$ or its equivalent $(\lambda_1/\lambda_2)^2$. In this embodiment, said factor is equal to 9.

It is also advantageous, with the purpose of reducing the manufacturing cost of such an antenna, to manufacture the constituent transducers of antenna 50 using a method which has the following two steps:

in a first step, a plate made of material intended to constitute the masses is joined to an acoustically transparent coating;

in a further step, said plate—but not the coating—is cut up so as to form an array of juxtaposed head masses.

The method of manufacturing the antenna can thus be as follows:

In a first step, threaded holes are made, in a square array (or matrix), in a plate of material suitable for constituting the head masses, for example aluminum, the distance separating two successive holes being substantially equal to half the wavelength $\lambda_2$.

In a second step, said plate is covered with a layer of acoustically transparent material. For example, this material can be rubber deposited by vulcanization so as to ensure complete adhesion. This coating is intended to constitute the sealed casing of the antenna at the torpedo head.

In a third step, grooves are made in the longitudinal direction and the transverse direction of the plate to constitute a mosaic of square head masses, whose axes correspond to those of the threaded holes and the length of whose sides is substantially equal to half the wavelength $\lambda_2$. These grooves are made by a milling operation.

In a fourth step, a prestressing rod, at least one of whose ends is threaded, is screwed into each of the threaded holes of the plate.

In a fifth step, a piezoelectric motor and then a tail mass, which have an axial hole and are dimensioned so as to operate at the two frequencies $\nu_1$ and $\nu_2$, are fastened to each of the prestressing rods, each transducer then being constituted.

As an example, another method of manufacturing transducers 60 of antenna 50 could be the following, as illustrated in FIGS. 3*a* to 3*d:*

In a first step, holes 64 having a countersinking 65 are made, in a square array (or matrix), in a plate 66 made of material suitable for constituting head masses, for example aluminum, the distance separating two successive holes 64 being substantially equal to half the wavelength $\lambda_2$.

In a second step, a prestressing rod 67 having a head 68 at one of its ends is fastened by adhesive bonding into each of holes 64, head 68 resting on countersinking 65 of plate 66 so as to be flush with upper part 66 thereof.

In a third step, upper surface 69 of plate 66 is covered with a layer 70 of acoustically transparent material, for example rubber deposited by vulcanization so as to ensure complete adhesion.

In a fourth step, grooves 71 are made in the longitudinal direction and in the transverse direction of the plate, but not in the coating, so as to constitute a mosaic of independent head masses 62 of square shape, the axes of which correspond to those of threaded holes 64 and the length of whose sides is substantially equal to half the wavelength $\lambda_2$. Said grooves 71 are made by means of a milling operation.

In a fifth step, a piezoelectric motor 61 and then a tail mass 63, which have an axial hole and are dimensioned so as to operate at the two frequencies $\nu_1$ and $\nu_2$, are fastened to each of the prestressing rods, each transducer then being constituted.

Figure 4:
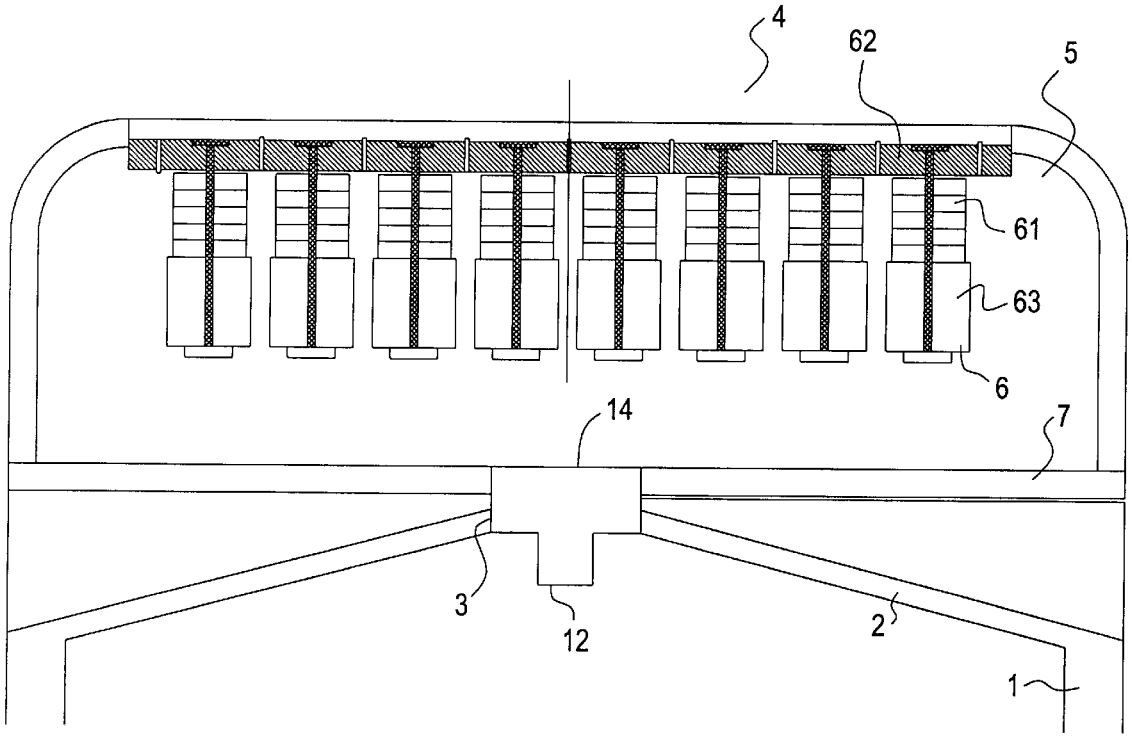
FIG. 4 shows a simplified diagram of a torpedo head having an antenna.
Figure 5:
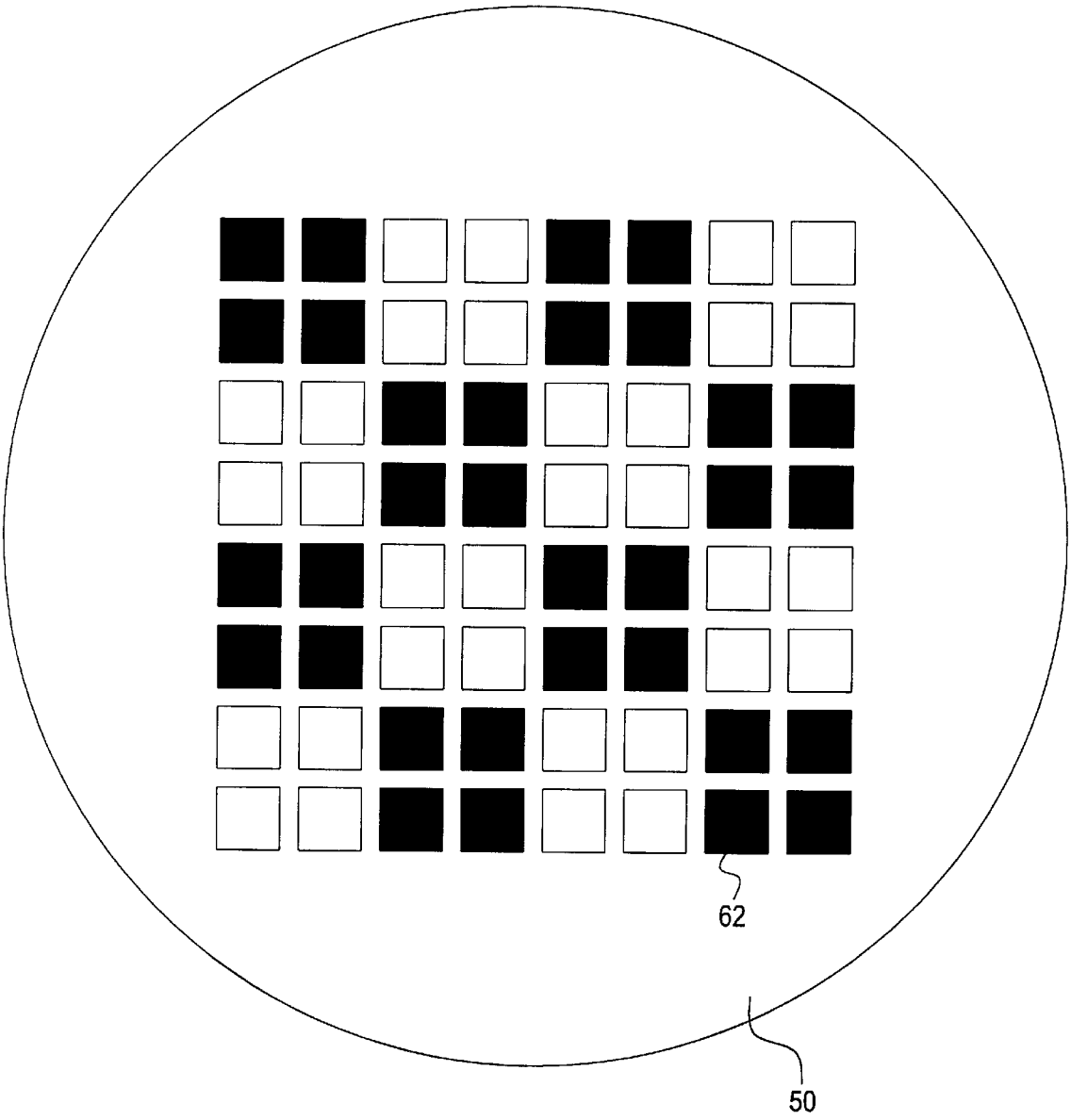
FIG. 5 shows a diagram of the way in which the transducers are grouped.

FIG. 4 is a sectional diagram of a sonar antenna according to the invention, installed on a torpedo having a hollow hull 1.

The hull of the vehicle has, at its front end, an element 2 intended to support the antenna. It is frustoconical in shape and has an axial hole 3. It is covered, from the periphery to the hole, with a material 7 capable of damping vibrations of the vehicle during operation, such as, for example, an elastomer with a high damping coefficient whose thickness is variable, and such that the cross section is substantially perpendicular to the axis of the vehicle.

In front of element 2 is a head 4 which has the general shape of a flattened arch and whose outer surface 70 has been joined, by vulcanization, to plate 66 intended to constitute the mosaic of transducers.

Head 4 constitutes a sonar antenna intended to perform functions of transmitting and receiving acoustic waves.

It has a core 5 which can be a block of syntactic foam, which has sufficient mechanical strength to withstand hydrostatic pressure and has an acoustic impedance different from that of the hull and the transducers, and a density less than 1.

Said core 5 has a flat front surface into which are recessed blind receptacles 6 intended to receive the network of "tonpilz" transducers, the constituent elements of which have been described previously, and the electrodes of which are connected to an electrical connector 12.

Blind receptacles 6 are connected to an axial cavity by orifices in core 5 inside which pass conductors connected to the electrodes and to connector 12 which is fastened, for example by means of a multiconductor cable, to the electronic equipment located inside the vehicle.

The head further has a jacket 7, made for example of acoustically transparent material like that which is affixed to cover the head masses.

The head is then fastened, in a known manner like for example that described in French Patent No. 2603761, to the hull by means of a centering and fastening element 14.

Dimensioning of the transducer head masses allows optimum operation of the antenna at all frequencies. Specifically, to produce correct area sampling at both frequency $\nu_1$ and frequency $\nu_2$, it is sufficient, for frequency $\nu_1$, to distribute the transducers in groups $\mathbf{80}_1$ to $\mathbf{80}_n$ in, for example, a square grid such that the equivalent characteristic dimension of each of the groups of transducers is substantially equal to half the wavelength $\lambda_1$ and, for each group, to combine the operation of the transducers which are part of it. For this purpose, the signals emerging from each element of a group, of for example 4 or 9 elements, are electronically summed by an operational amplifier, thus constituting a single source that is processed by the preforming circuits.

The number of transducers per group is on the order of the ratio $(\lambda_1/\lambda_2)^2$, i.e. 9 in this embodiment of the invention.

It is obvious that numerous modifications can be made to the embodiment presented here. For example, the transducer can be dimensioned to operate at more than two frequencies, the dimension of the masses still being dimensioned with respect to the highest operating frequency and the transducers operating in groups of transducers, the number of which depends on the operating frequency. In addition, for the sake of simplicity the number of transducers per group can be selected so that, for the frequency in question, the characteristic dimension of the head mass of said transducers is between approximately 0.35 and 0.65 times the corresponding wavelength, and the number of transducers per group is selected from among the values 4, 9, 16, etc., i.e. $n^2$, n being an integer.

I claim:

1. A method of implementing an antenna operating at a frequency $\nu_2$ in order to make it operate at a second lower frequency $\nu_1$, the antenna having at least two identical transducers, each of the at least two identical transducers comprising a headmass whose dimension is between 0.35 and 0.65 times the wavelength $\lambda_2$ corresponding to the frequency $\nu_2$, wherein it consists, when the antenna is operating at frequency $\nu_1$, in grouping the operation of said transducers so that the equivalent characteristic dimension of the headmasses of said group of transducers is between 0.35 and 0.65 times the wavelength $\lambda_1$ corresponding to the frequency $\nu_1$.

2. The method according to claim 1, wherein when operating at the frequency $\nu_1$, for each group, the signals emerging from transducers from the same group are electronically summed and, subsequently, processed.

3. The method according to claim 2, wherein signals are summed by an operational amplifier.

4. The method according to claim 2, wherein said summed signals is processed by a performing circuit.

* * * * *